US008790141B2

(12) United States Patent
Aita

(10) Patent No.: US 8,790,141 B2
(45) Date of Patent: Jul. 29, 2014

(54) CONNECTOR KEYING SYSTEM AND METHOD FOR ASSEMBLING THIS SYSTEM ONTO A CONNECTOR

(71) Applicant: Souriau, Versailles Cedex (FR)

(72) Inventor: Franck Aita, Elancourt (FR)

(73) Assignee: Souriau, Versailles (FR)

( * ) Notice: Subject to any disclaimer, the term of this patent is extended or adjusted under 35 U.S.C. 154(b) by 159 days.

(21) Appl. No.: 13/655,775

(22) Filed: Oct. 19, 2012

(65) Prior Publication Data

US 2013/0102202 A1 Apr. 25, 2013

(30) Foreign Application Priority Data

Oct. 20, 2011 (FR) ..... 11 59536

(51) Int. Cl.
*H01R 13/64* (2006.01)
*H01R 24/00* (2011.01)
*H01R 13/645* (2006.01)

(52) U.S. Cl.
CPC ..... *H01R 13/6456* (2013.01); *H01R 24/00* (2013.01)
USPC ..... 439/680

(58) Field of Classification Search
CPC ..... H01R 13/64; H01R 13/6456; H01R 12/7005; H01R 13/6453; H01R 13/514
USPC ..... 439/680, 681
See application file for complete search history.

(56) References Cited

U.S. PATENT DOCUMENTS

| | | | | |
|---|---|---|---|---|
| 3,818,420 | A * | 6/1974 | Barr | 439/261 |
| 4,595,250 | A | 6/1986 | Joly et al. | |
| 5,449,302 | A * | 9/1995 | Yarbrough et al. | 439/680 |
| 7,892,042 | B2 * | 2/2011 | Spicer et al. | 439/681 |

FOREIGN PATENT DOCUMENTS

| | | |
|---|---|---|
| EP | 0 125 952 A1 | 11/1984 |
| EP | 1 587 180 A1 | 10/2005 |
| FR | 2 036 634 A6 | 12/1970 |

OTHER PUBLICATIONS

French Search Report, dated Jun. 11, 2012, from corresponding French application.

* cited by examiner

*Primary Examiner* — Xuong Chung Trans
(74) *Attorney, Agent, or Firm* — Young & Thompson

(57) ABSTRACT

A connector keying system includes a receptacle (3) assembled at one end of a first electrical cable and a plug (4) assembled at the end of a second electrical cable and designed to be connected to the receptacle. The system includes:—at least one coding ring (1) capable of being at least partially assembled around the receptacle (3) and including a plurality of guide notches (P) and a keying recess (12),—at least one keying plate (2) capable of being attached to the plug (4) and including a keying lug (22) capable of being inserted into the keying recess (12) of the coding ring (1).

9 Claims, 5 Drawing Sheets

| | Coding ring: position A | | | | position B (180°) | | | |
|---|---|---|---|---|---|---|---|---|
| | P1 | P2 | P3 | P4 | P5 | P6 | P7 | P8 |
| Plate 2b | X | | | X | X | | | X |
| Plate 2a | | X | X | | | X | X | |
| Facing upwards | X | X | | | | | X | X |
| Facing downwards | | | X | X | X | X | | |

Fig. 5A

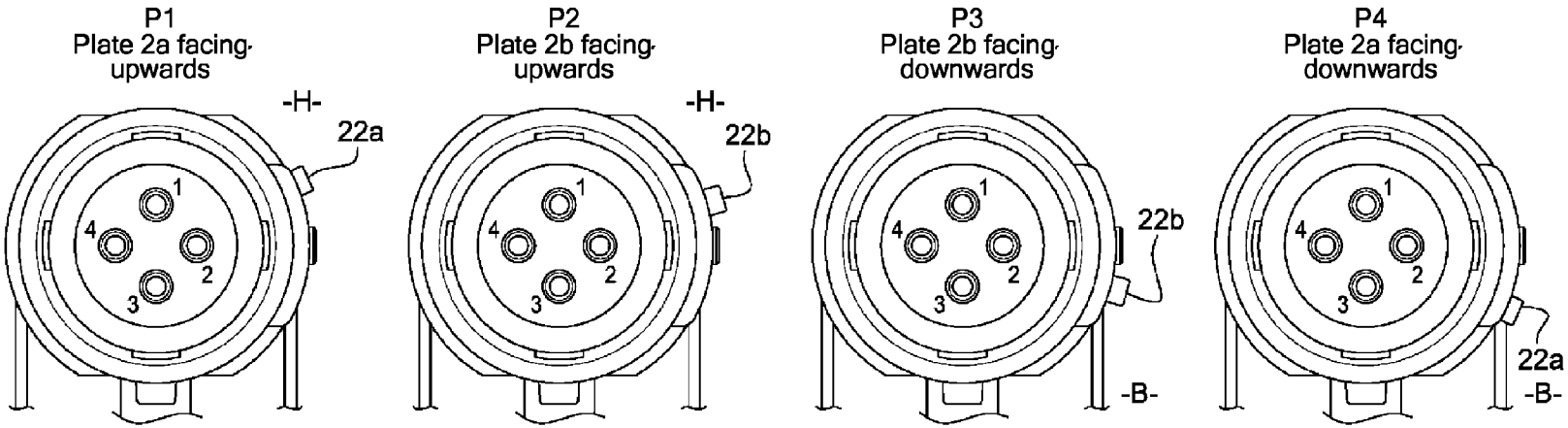
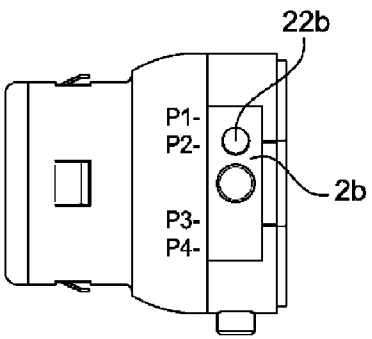
Fig.5B
Fig. 5C
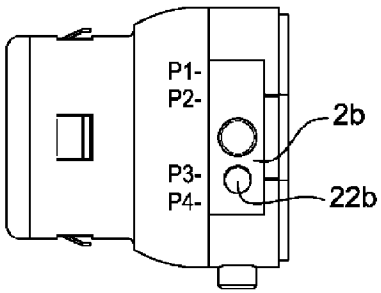
Fig.5D
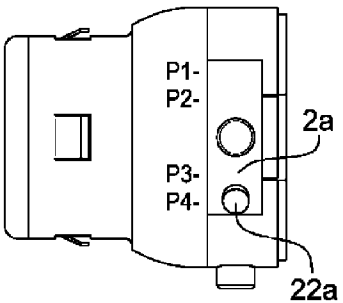
Fig.5E

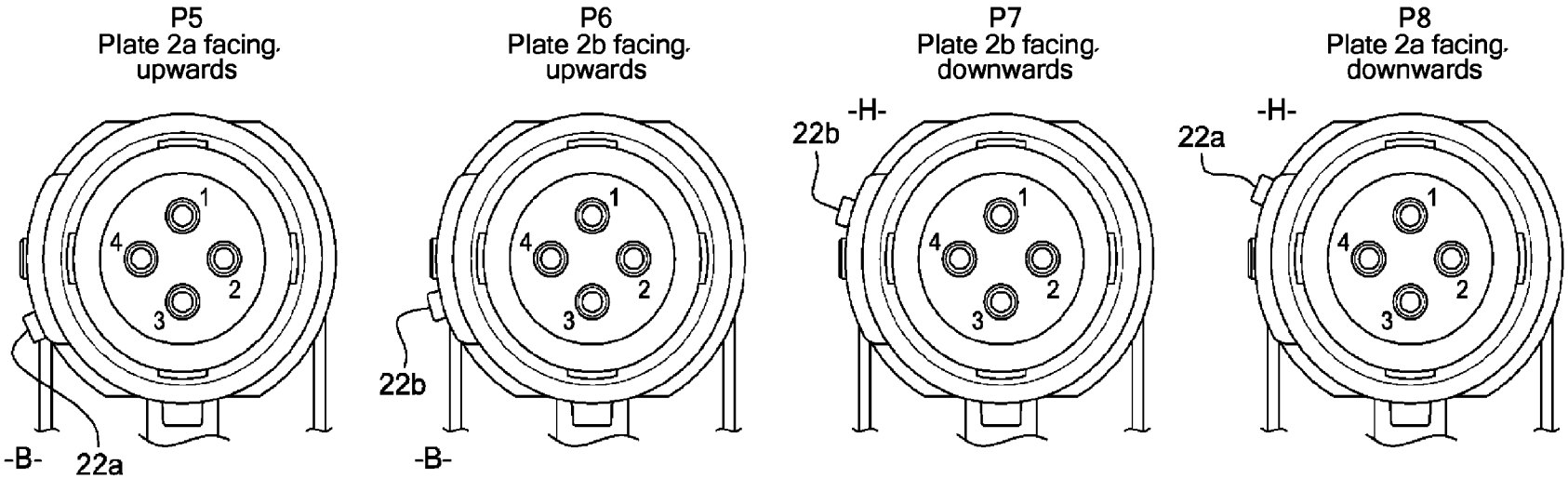
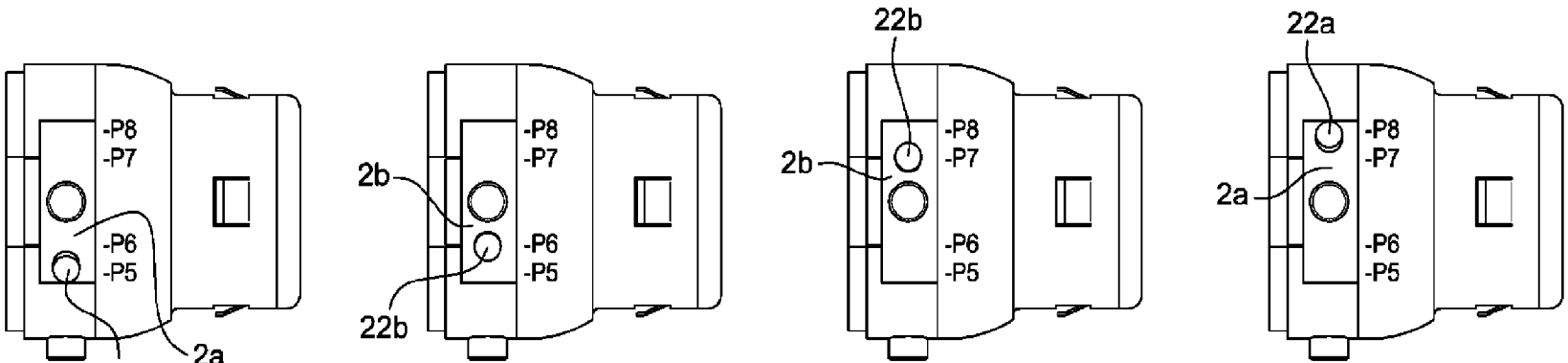
Fig.5F
Fig. 5G
Fig.5H
Fig. 5I

CONNECTOR KEYING SYSTEM AND METHOD FOR ASSEMBLING THIS SYSTEM ONTO A CONNECTOR

FIELD OF THE INVENTION

The invention relates to a configurable keying system designed to be assembled onto an electrical connector, this system offering a plurality of possible coding systems between the connector plug and receptacle.

The invention also relates to a method for installing such a keying system, with this system being suitable for installation on standard connectors.

The invention can be applied in many different fields using electrical connectors. It can more specifically be applied in harsh environments such as in the nuclear field and in particular for waste treatment plants.

PRIOR ART

In the field of connectors and in particular that of connectors used in nuclear power plants, it is important that a connector plug is designed to be connected to a specific receptacle. Indeed, in nuclear power plants the connection of the two elements comprising a connector (receptacle and plug) is often made in difficult conditions with poor access to these elements and reduced visibility. It must therefore be ensured that the plug and receptacle of the same connection assembly are correctly connected together and that the assembly plug cannot be connected to the receptacle of a different assembly.

In order to achieve this, each connection assembly (receptacle and plug) is generally equipped with a differentiation means preventing the connection of a given plug to any receptacle, but permitting the connection of this plug to a specific receptacle for which it was designed. The differentiation means generally used in the field of connectors is a key. A "key" is a mechanical device for preventing assembly, attachment or connection errors. A key is generally comprised from a recess made in one of the connector elements and a lug assembled onto the other element of said connector with the lug being capable of being inserted into the recess when the two connector elements are correctly connected together.

However, for installation with multiple connections, in order to guarantee the correct connection of each plug with its associated receptacle, each connection assembly must be equipped with a different key. For example, in order to install eight connection assemblies, eight different keys are required, which represents sixteen different plug and receptacle reference items. The operator responsible for this installation must therefore order sixteen different reference items from his/her supplier, with all associated risks of errors being made. If a reference number is not entered correctly or if a plug or receptacle ordered is not available, the eight connections making up the system must be postponed, with all associated consequences in terms of time and cost that this could cause.

DESCRIPTION OF THE INVENTION

The purpose of this invention is to overcome the disadvantages of the aforementioned techniques. For this purpose, the invention relates to a configurable keying system capable of being adapted to suit any type of standard connector.

The keying system of the invention is present in the form of a kit comprising a coding ring designed for assembly on the receptacle and a keying plate designed for assembly on the plug. The keying plate comprises a keying lug which can be placed in several different positions. The coding ring comprises a keying recess associated with multiple guide notches so as to produce, in association with the keying plate, multiple different keying configurations.

More specifically, the invention relates to a connector keying system comprising a receptacle assembled at one end of a first electrical cable and a plug assembled at the end of a second electrical cable and designed to be connected to the receptacle. This system is characterised by the fact that it comprises:

at least one coding ring capable of being at least partially assembled around the receptacle and comprising a plurality of guide notches P and a keying recess, at least one keying plate capable of being attached to the plug and comprising a keying lug capable of being inserted into the keying recess of the coding ring.

Advantageously, this system can be installed onto an existing connector. Advantageously, it can also provide several different keying configurations within the same kit.

The system of the invention can comprise one or several of the following characteristics:

the guide notches P of the coding ring are located on either side of the keying recess in two opposite series.

each series of guide notches P contains four guide notches each positioned facing a guide notch of the opposite series.

the coding ring can be configured in two opposing positions, thus providing eight possible coding systems.

the keying plate comprises a central bore capable of receiving a fixing device and aligned with the keying lug.

it comprises at least two keying plates, the keying lug of each of said plates being located at a different distance from the central bore.

each plate can be attached facing a first or second direction, thus providing the keying lug with two possible positions.

the coding ring is circular in shape.

The invention also relates to a connector equipped with the aforementioned keying system of the invention.

It also relates to a method for installing this keying system. This method comprises the following operations:

assembling a coding ring around the connector receptacle, turning the coding ring according to the chosen configuration, choosing a keying strip adapted to suit the chosen configuration, attaching the chosen keying strip to the connector plug in a direction adapted to suit the chosen configuration, connecting the plug to the receptacle so that the keying lug of the keying plate is inserted into the keying recess of the coding ring.

BRIEF DESCRIPTION OF THE FIGURES

The invention will be better understood after reading the following description and after examining the accompanying figures. These figures are intended for purposes of illustration only and are not intended to limit the scope of the invention.

FIGS. 5A to 5I show the different keying configurations that can be obtained with the keying system of the invention.

DETAILED DESCRIPTION OF THE EMBODIMENTS OF THE INVENTION

The keying system of the invention is a configurable system present in the form of a kit or assembly designed to suit existing standard connectors.

This kit comprises at least one coding ring and one keying plate. In the preferred embodiment of the invention described hereinbelow, the kit comprises one coding ring and two keying plates. Each plate comprises a keying lug located in a different position on each plate. Each coding ring comprises several guide notches located on either side of a keying recess. These keying plates associated with the coding ring provide sixteen different keying configurations.

However, it is understood that a kit can contain a single plate or, on the other hand, multiple plates each equipped with a keying lug located in a different position on each plate. Similarly, the kit can contain several coding rings, each ring having guide notches located in different positions in relation to the keying recess. By changing the number of keying plates and the number of coding rings constituting a kit, the number of possible keying configurations provided by this kit can be adapted to match the number of connectors requiring differentiation.

Figure 1:
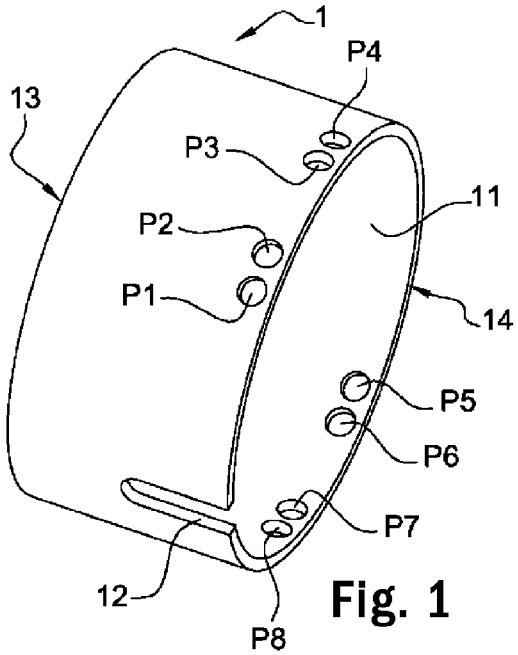
FIG. 1 represents a perspective view of a coding ring of the system of the invention.

FIG. 1 shows an example of a coding ring according to the preferred embodiment of the invention. This coding ring 1 is a hollow element comprising a wall 11 with a shape designed to suit the receptacle on which it must be assembled. It can, for example, be made from a metallic or thermoplastic material.

This coding ring 1 comprises an inner surface 13 designed to be positioned facing the receptacle and an outer surface 14, opposite the inner surface 13, designed to be positioned near to the connector plug.

In the preferred embodiment of the invention, the wall 11 is circular in shape with a diameter adapted to suit standard connector receptacles. This wall 11 is equipped with a keying recess 12. This recess 12 is oblong in shape and opens out onto the outer surface 14 of the coding ring. As described in more detail hereinbelow, this keying recess 12 is designed to house a keying lug.

The wall 11 of the coding ring also comprises a plurality of guide notches, referenced P1 to P8, distributed along the contour of said wall in a predetermined order. In the preferred embodiment of the invention, eight guide notches P1 to P8 are located in two series of four on either side of the keying recess 12, i.e. P1 to P4 to the right of the recess 12 and P5 to P8 to the left of said recess 12, as shown in FIG. 1 and in FIGS. 5B to 5I. These two series of guide notches P1 to P4 and P5 to P8 can be positioned in a symmetrical manner in relation to the recess 12, opposite each other. Preferably, these guide notches are positioned in pairs along the contour of the wall: P1 with P2, P3 with P4, P5 with P6 and P7 with P8, with the distance between each pair exceeding the distance between two guide notches.

Figure 2A:
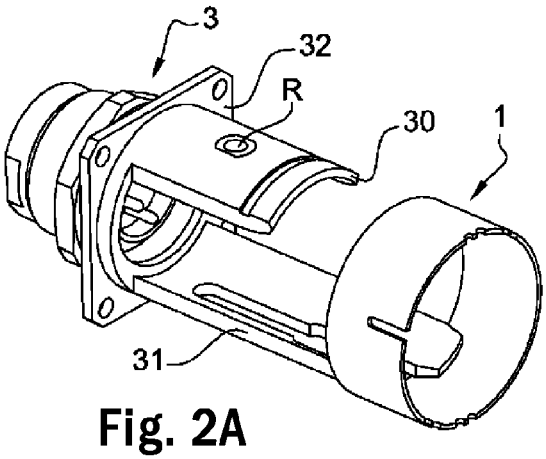
FIGS. 2A and 2B represent perspective views of the assembly of the coding ring in FIG. 1 onto a connector receptacle.
Figure 2B:
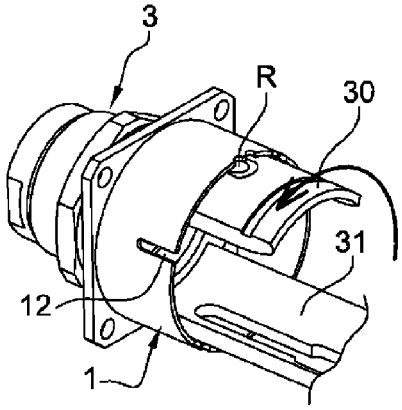

The coding ring 1 in FIG. 1 is designed for assembly onto a standard receptacle 3 as shown in FIGS. 2A and 2B. More precisely, the coding ring 1 is assembled by sliding this along the protruding walls 30 and 31 of the receptacle 3. The coding ring 1 is assembled so that its inner surface 13 abuts against the base 32 of the receptacle 3, with its outer surface 14 thus being free. As shown in FIG. 2B, once the coding ring 1 is assembled around the receptacle 3, said coding ring can be rotated in order to turn the guide notches P to a chosen configuration. It should be noted that the coding ring must be positioned in such a way that its recess 12 is located between the protruding walls 30 and 31 of the receptacle. A positioning notch R made in the protruding wall 30 of the receptacle 3 defines the positions P1 to P8 of the coding ring. This positioning notch R can be a coloured notch, a protruding semi-circle or any other mark visible through the guide notches P.

Figure 3:
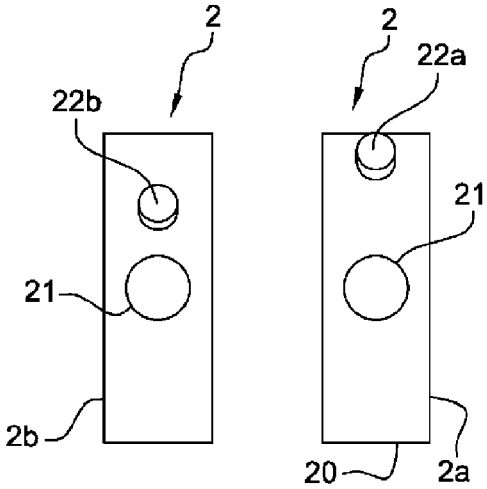
FIG. 3 represents a front view of a set of keying plates according to the invention.

As previously explained, the keying system of the invention comprises at least one plate 2 as shown in FIG. 3. In the preferred embodiment of the invention, it comprises two plates referenced 2*a* and 2*b*. These plates, for example made from a metallic or thermoplastic material, have identical dimensions. The centre of each comprises a central bore 21 designed to house fixing means such as a screw. Each of these plates 2*a* and 2*b* also comprises a keying lug 22*a*, 22*b* aligned with the central bore 21 along a line parallel to the plate's border. These two lugs have identical dimensions and are each designed to be inserted into the keying recess 12 of the coding ring. According to the invention, this lug 22*a* or 22*b* is located in a different position in relation to the bore 21 on plate 2*a* and plate 2*b*. More precisely, the distance between the lug 22*b* and the bore 21 of the plate 2*b* is different to the distance between the lug 22*a* and the bore 21 of the plate 2*a*. It is understood that this variation in distance between the lug and the bore enables the plate to be adapted to suit the chosen configuration.

Figure 4:
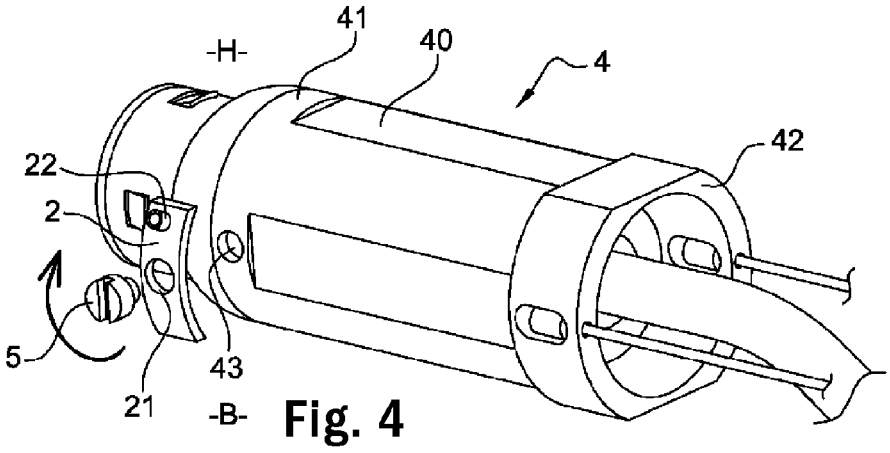
FIG. 4 represents a perspective view of a connector plug on which a plate in FIG. 3 is assembled.

According to the invention, one of these plates 2*a* or 2*b* is attached to the plug 4 as shown in FIG. 4. More precisely, it can be attached to the front part 41 of the outer wall 40 of the plug 4, said front part 41 being the part designed to fit into the receptacle 3, as opposed to the rear part 42 designed to house the connection cables. As shown in FIG. 4, the plate 2 is attached to the wall 40 by means of a fixing device 5, such as a screw, which passes through the bore 21 of the plate 2 in order to be screwed into a bore 43 of the wall 40.

This plate 2 can be attached in two different positions per side (right side and left side) of the plug 4:

in a first position, the lug 22 of the plate 2 is attached facing upwards H in relation to the plug 4, and in a second position, the lug 22 of the plate 2 is attached facing downwards B in relation to said plug 4.

Therefore the same plate 2 can provide two different positions per side for the same lug, which allows for four different coding possibilities, i.e. four keying configurations. As the system of the invention, in its preferred embodiment, comprises two plates with different lug positions, said system thus provides eight different lug positions, i.e. eight keying configurations.

FIGS. 5A, 5B, 5C, 5D, 5E, 5F, 5G, 5H and 5I show the different keying configurations that can be obtained with a system according to the preferred embodiment of the invention. More precisely, FIG. 5A shows a table summarising the different configurations. In this table, the positions P1 to P8 of the guide notches of the coding ring are provided in columns, whereas the positions of the plate lugs are provided in rows.

The four guide notch positions P1 to P4 corresponding to the positions when the coding ring is in position A in FIG. 1 (i.e. P1 to P4 facing upwards, as shown in FIG. 1) are each associated with a lug position of one of the plates 2*a* or 2*b*. For example the guide notch position P1 corresponds to the lug of the second plate, or plate 2*a* in FIG. 3, when said plate is facing upwards H as shown in FIG. 5B. The guide notch position P2 corresponds to the lug of the first plate, or plate 2*b* in FIG. 3, when said plate is facing upwards H as shown in FIG. 5C. The guide notch position P3 corresponds to the lug of the first plate 2*b*, when said plate is facing downwards B as shown in FIG. 5D. The guide notch position P4 corresponds to the lug of the second plate 2*a*, when said plate is facing downwards B as shown in FIG. 5E.

Similarly, the four guide notch positions P5 to P8 corresponding to the position when the coding ring is in position B rotated by 180° in relation to position A (i.e. P1 to P4 facing downwards) are each associated with a lug position of one of the plates 2*a* or 2*b*. For example, the guide notch position P5 corresponds to the lug of the second plate 2*a*, when said plate is facing downwards B as shown in FIG. 5F. The guide notch position P6 corresponds to the lug of the first plate 2*b*, when said plate is facing downwards B. The guide notch position P7 corresponds to the lug of the first plate 2*b*, when said plate is facing upwards H as shown in FIG. 5H. The guide notch position P8 corresponds to the lug of the second plate 2*a*, when said plate is facing upwards H.

This table therefore summarises the eight keying configurations capable of being obtained from a kit comprising one coding ring 1 and two keying plates 2*a* and 2*b*.

Figure 6A:
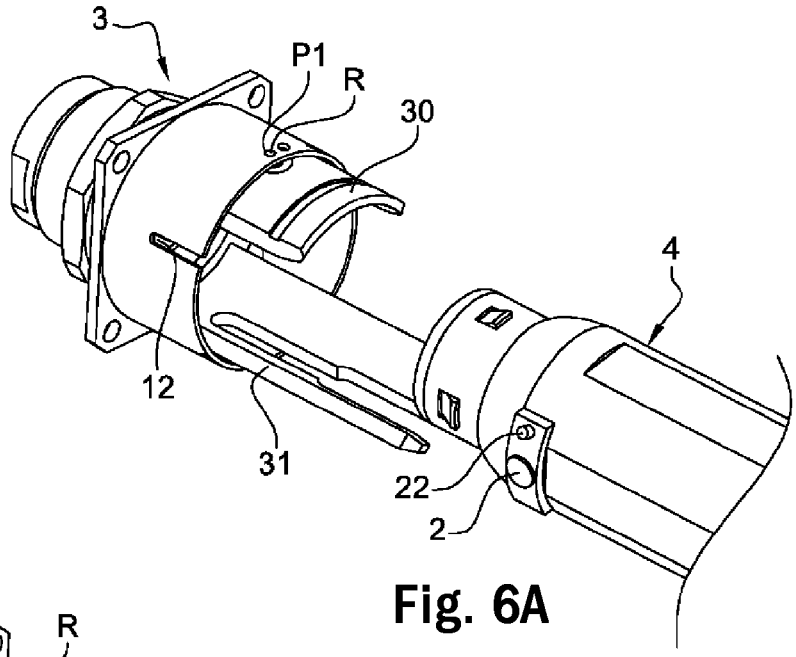
FIGS. 6A, 6B and 7 represent examples of connectors each equipped with a keying system according to the invention.
Figure 6B:
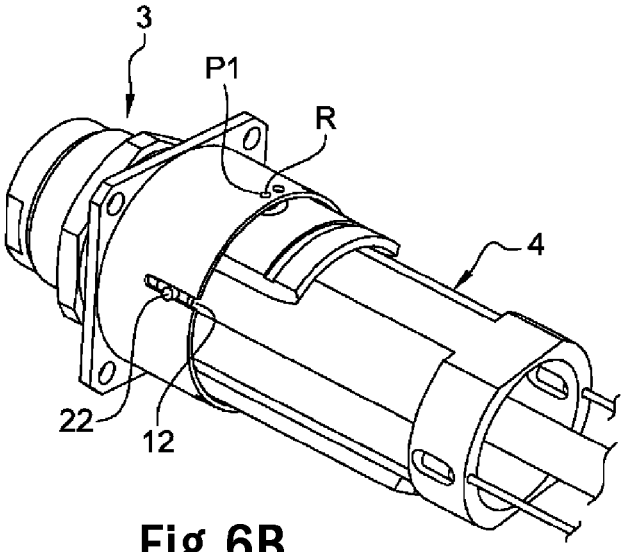

FIGS. 6A and 6B show a connector equipped with the keying system of the invention during the assembly of a plug 4 onto a receptacle 3. FIG. 6A shows the plate 2 attached to the plug 4 with its lug facing upwards and the coding ring 1 assembled around the receptacle 3 in a position A (with P1-P4 facing upwards). The plug 4 is therefore inserted between the protruding walls 30 and 31 of the receptacle 3 in such a way that the lug 22 of the plate 2 is inserted into the keying recess 12 of the coding ring 1. If the connection between the plug 4 and the receptacle 3 is possible, as shown in FIG. 6B, said plug and said receptacle are therefore correctly coded, for example in position P1. However, if the connection is not possible, this means that the plug and the receptacle are coded using a different coding system, for example the plug in position P1 and the receptacle in position P2. As shown in FIG. 6B, the lug 22 is correctly housed in the recess 12, which means that the receptacle and the plug are coded according to the same coding system. If the coding system is the P1 coding system, the plate 2 on the plug 4 is a plate 2*a* as shown in FIG. 3 facing upwards and the coding ring 1 is assembled in position A with the guide notch P1 below the positioning notch R. Only this combination of coding ring and plate 2*a* positions enables a connection to be made between the plug and the receptacle.

Figure 7:
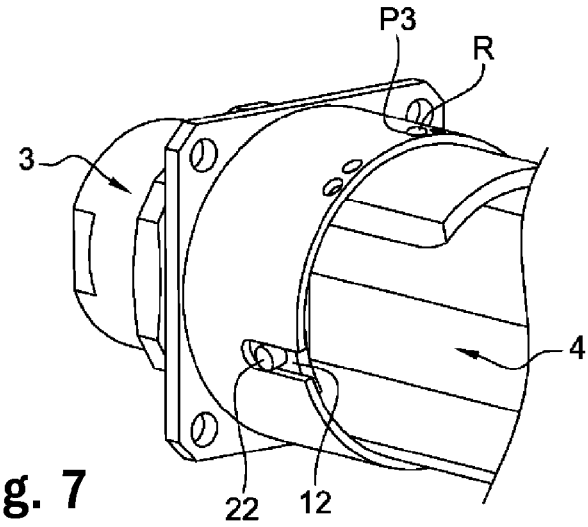

Another example for assembling a plug onto a receptacle is shown in FIG. 7. In this example, the coding system P3 has been chosen as the keying configuration. In this case, the coding ring 1 is assembled in position A onto the receptacle 3. However, for the coding system P3 to appear at the level of the positioning notch R, the coding ring has been slightly rotated in an anticlockwise direction so that the recess 12 is moved downwards in relation to the position of said recess 12 shown in FIG. 6A. In this case, the plate attached to the plug 4 is a plate 2*b* facing downwards.

Using the information previously given, it is therefore deduced that the combination of one or several keying plates with one or several coding rings provides a number of keying combinations adapted to suit the system's dimensions, given that a kit comprising 2 plates and one coding ring provides for 8 possible configurations and that a kit comprising 3 plates and one ring is capable of providing for 12 configurations, etc. Given that these kits are designed for assembly onto existing connectors, they can be easily installed onto any electrical system. Furthermore, they provide the advantage of limiting the number of reference items ordered to 3 for eight different keying configurations.

The invention claimed is:

1. A connector keying system comprising a receptacle (3) assembled at one end of a first electrical cable and a plug (4) assembled at the end of a second electrical cable and designed to be connected to the receptacle, characterised in that it comprises:

at least one coding ring (1) capable of being at least partially assembled around the receptacle (3) and comprising a plurality of guide notches (P) and a keying recess (12), at least one keying plate (2) capable of being attached to the plug (4) and comprising a keying lug (22) capable of being inserted into the keying recess (12) of the coding ring (1);

characterised in that the keying plate (2) comprises a central bore (21) capable of receiving a fixing device (5) and aligned with the keying lug (22).

2. A keying system according to claim 1, characterised in that the guide notches (P) of the coding ring (1) are located on either side of the keying recess in two opposite series.

3. A keying system according to claim 2, characterised in that each series of guide notches (P) contains four guide notches (P1-P4, P5-P8) each positioned facing a guide notch of the opposite series.

4. A keying system according to claim 3, characterised in that the coding ring (1) can be configured in two opposing positions (A, B), thus providing eight possible coding systems.

5. A keying system according to claim 1, characterised in that it comprises at least two keying plates (2*a*, 2*b*), the keying lug (22) of each of said plates being located at a different distance from the central bore (21).

6. A keying system according to claim 1, characterised in that each plate (2*a*, 2*b*) can be attached facing a first or second direction, thus providing the keying lug (22) with two possible positions per side of the plug (4).

7. A keying system according to claim 1, characterised in that the coding ring (1) is circular in shape.

8. An electrical connector comprising a receptacle (3) and a plug (4), characterised in that it also comprises a keying system according to claim 1.

9. A method for installing a keying system onto a connector according to claim 8, characterised in that it consists in performing the following operations:

assembling a coding ring (1) around the connector receptacle (3), turning the coding ring according to the chosen configuration (P1-P8), choosing a keying strip (2) adapted to suit the chosen configuration, attaching the chosen keying strip (2) to the connector plug (4) in a direction adapted to suit the chosen configuration, connecting the plug (4) to the receptacle (3) so that the keying lug (22) of the keying plate is inserted into the keying recess (12) of the coding ring (1).

* * * * *